United States Patent [19]

Foster et al.

[11] Patent Number: 4,917,811

[45] Date of Patent: Apr. 17, 1990

[54] BLEACH COMPOSITIONS AND PROCESS FOR MAKING SAME

[75] Inventors: Jeffrey N. Foster, Rutherford, N.J.; William M. Karpusiewicz, Floral Park, N.Y.; Charles F. Irwin, Randolph; Hien T. Pham, Fort Lee, both of N.J.; Michael P. Aronson, West Nyack, N.Y.

[73] Assignee: Lever Brothers Company, New York, N.Y.

[21] Appl. No.: 292,692

[22] Filed: Jan. 3, 1989

Related U.S. Application Data

[63] Continuation-in-part of Ser. No. 246,836, Sep. 20, 1988, abandoned.

[51] Int. Cl.[4] ..... C11D 3/395; C11D 3/39; D06L 3/02

[52] U.S. Cl. ..... 252/95; 252/186.23; 252/186.26; 252/99; 252/174.14; 252/186.42

[58] Field of Search ..... 252/186.26, 186.23, 252/99, 174.14, 95

[56] References Cited

U.S. PATENT DOCUMENTS

| | | | |
|---|---|---|---|
| 3,451,935 | 6/1969 | Roald | 252/174.12 |
| 3,494,786 | 2/1970 | Nielsen | 252/95 X |
| 3,494,787 | 2/1970 | Lund et al. | 117/100 |
| 3,563,687 | 2/1971 | Moyer | 8/111 |
| 3,770,816 | 11/1973 | Nielsen | 260/502 |
| 4,091,544 | 5/1978 | Hutchins | 34/9 |
| 4,100,095 | 7/1978 | Hutchins et al. | 252/99 |
| 4,170,453 | 10/1979 | Kitko | 252/99 X |
| 4,818,425 | 4/1989 | Meijer et al. | 252/186.26 X |

FOREIGN PATENT DOCUMENTS 1387167 3/1975 United Kingdom .

*Primary Examiner*—Brooks H. Hunt
*Assistant Examiner*—Virginia B. Caress
*Attorney, Agent, or Firm*—Milton L. Honig

[57] ABSTRACT

Dry, granular bleach compositions comprising an organic peroxycarboxylic acid as the active bleaching agent are obtained by cogranulating the acid with a strongly alkaline, hydratable inorganic or organic salt.

These cogranulates show a reduced tendency to decompose or detonate. A typical cogranulate is made from diperoxydodecanedioic acid and dibasic sodium orthophosphate with seven moles of water of hydration.

The cogranulates are useful as bleach ingredients in detergent and cleaning compositions.

6 Claims, No Drawings

BLEACH COMPOSITIONS AND PROCESS FOR MAKING SAME

CROSS-REFERENCE TO RELATED APPLICATIONS

This application is a continuation-in-part of co-pending application of Ser. No. 246,836, filed Sept. 20, 1988.

BACKGROUND OF THE INVENTION

1. Field of the Invention

The present invention relates to dry, granular bleach compositions comprising an organic peroxycarboxylic acid as the active bleaching agent, and to a process for making such dry, granular bleach compositions.

2. Description of the Related Art

Granular bleach compositions which comprise an organic peroxycarboxylic acid as the active bleaching agent are known in the art. Thus, Lund et al. disclose in their U.S. Pat. No. 3,494,787 dry granular compositions of diperphthalic acid, encased in a protective coating of hydrated salts. These salts are slightly acidic or essentially neutral. These dry granular compositions are prepared by feeding an aqueous dispersion of the diperphthalic acid into a fluidized bed of incompletely or non-hydrated salt particles. These compositions exhibit a reduced tendency to detonate or explode.

Similarly, Nielsen in U.S. Pat. No. 3,770,816 discloses non-detonable granular bleach compositions comprising diperisophthalic acid and an inert hydrated salt. These compositions are prepared in granular form by admixing unhydrated or partially hydrated salts with e.g. a water-wet filter cake comprising the diperisophthalic acid in such proportion that the salt takes up the water in the filter cake to form a hydrate. In doing so, granular compositions are obtained. The salts used are slightly acidic or essentially neutral.

More recently, attention has been focused on other, aliphatic organic peroxyacids such as diperoxydodecanedioic acid (DPDA) as a suitable bleaching agent, e.g. for inclusion in detergent and cleaning compositions. Like the aforesaid diperphthalic acids, such aliphatic organic peroxyacids can decompose exothermally nd can detonate or explode. In U.S. Pat. No. 4,091,544 (Hutchins), it is proposed to prepare e.g. DPDA-granules by forming a water-wet mixture of DPDA with a hydratable salt above the hydration temperature, comminuting said mixture, cooling the comminuted mixture to below the hydration temperature and subsequently drying the mixture to remove free water and water of hydration. The hydratable salts include sodium sulphate, calcium bromide, ferric bromide, ferric chloride, ferric nitrate, lithium bromide, sodium acetate, sodium arsenate, sodium perborate, sodium phosphite, sodium acid phosphite and stannous chloride. In U.S. Pat. No. 4,100,095 (Hutchins et al.), granular DPDA-compositions are described which contain, as exotherm control agents, a non-hydrated salt which chemically decomposes to give off water below the decomposition temperature of DPDA.

SUMMARY OF THE INVENTION

It has now been found that aliphatic organic peroxyacid containing granules with a reduced tendency to decompose and/or to detonate and explode can be obtained by cogranulating these peroxy acids with a strongly alkaline, hydratable inorganic and/or organic salt in the presence of water. According to the invention, aliphatic organic peroxyacid-containing granules with an increased level of aliphatic organic peroxyacid, compared with currently commercially available aliphatic organic peroxyacids-containing granules, can be obtained, which nevertheless have a reduced tendency to decompose, detonate or explode. In contrast to the above prior art, where either slightly acidic or essentially neutral hydratable salts are used, or where the granules are dried to remove the water of hydration, or where water is chemically released, the granules of the present invention contain a strongly alkaline hydratable salt, which is hydrated during the cogranulation, yielding aliphatic organic peracids/hydrated alkaline salt cogranules. Whereas in the above prior art it is said that it is not considered desirable to combine the organic peracid with strongly alkaline materials, it is surprising that in the present invention, with the use of such strongly alkaline materials, a chemically storage-stable, non-detonating product is obtained.

Consequently, in its broadest aspects the present invention relates to a co-granulate of aliphatic organic peracids with a strongly alkaline, hydrated inorganic and/or organic salt, said cogranulate comprising from 1 to 45 % by weight of aliphatic organic peracids and from 99 to 35 % by weight of the strongly alkaline, hydrated inorganic and/or organic salt.

DETAILED DESCRIPTION OF THE INVENTION

For simplicity's sake, the invention will be described with particular reference to DPDA, it being understood however that this does not imply a limitation. Other aliphatic organic peroxyacids can be used instead of DPDA, as will be set out hereinafter.

The DPDA used in the present invention is normally a solid, water-dispersible compound. It is usually commercially manufactured in the form of a dry, granular form, with the aid of sodium sulphate as an inert carrier material for the DPDA. Such commercially available granular DPDA products usually contain about 12% of DPDA. The present invention aims at obtaining dry, granular DPDA forms with a much higher level of DPDA, in the order of up to 45%. Usually, the level of DPDA ranges from 5–35%, and preferably from 15–30%.

The strongly alkaline, hydratable salt can be an inorganic or organic salt. These salts should yield a pH of at least 8.5 at a concentration of 1% in distilled water at 25° C., preferably at least 9.0.

These hydratable salts can be used in the anhydrous form, or in a partially hydrated form. Typical examples of suitable hydratable salts according to the invention are alkalimetal carbonates,-orthophosphates -perborates, - metaborates, - pyrophosphates, -triphosphates, -sesquicarbonates, - silicates, - citrates, - tartrates, - succinates,-nitrilotriacetates. In general, those salts are preferred which can take up high levels of water of hydration, such as sodium tetraborate, sodium carbonate, sodium orthophosphate, tetrasodium-pyrophosphate, pentasodiumtriphosphate. Preferred are anhydrous salts such as dibasic sodium orthophosphate which can accept 12 moles of water of hydration. Particularly preferred salts are those that release water near or below the decomposition temperature of the DPDA. Naturally, mixtures of different salts can be used, as well as, mixtures of salts with different degrees of hydration. The amount of strongly alkaline, hydratable salt used in the present invention is of course dependent upon the amount of water used in the cogranulation process, as well as on the hydration capacity of the salts used. The ratio of free water to the amount of water that can be taken up as water of hydration is generally below 1. In general, the amount of salt used will be such, that all the water is taken up by the hydratable salt as moles of water of hydration. In general, the amount ranges from 99–35% by weight of the granule. Care should be taken that the waters of hydration is taken up before the DPDA can dissolve in the aqueous medium. This can be achieved e.g. by spraying an aqueous DPDA-dispersion onto a moving bed of the strongly alkaline, hydratable salt, e.g. a fluidized bed. Other cogranulation methods can however also be used, such as pan-granulation, rotationary granulation, milling, rolling-drum granulation, marumerizing, flaking etc., in appropriate granulation equipment such as Hobarth mixers, Eirich-pan granulators, Lodige mixers, Schugi mixers, Marumerizers and the like. Naturally, the process conditions, in particular the granulation temperature, should be such that no energy is supplied to cause the DPDA to detonate.

The granules of the invention can also contain inert neutral salts such as sodium sulphate which is present in the commercially available DPDA products, as well as minor amounts of other materials with particular benefits, such as materials improving the dissolution of the granules in water, e.g. anionic surfactants, or exothermic control agents such as boric acid. Chelating agents such as aminophosphonic acids, hydroxyalkanephosphonic acids, picolinic acid, quinoline, etc. may also be usefully included in minor amounts. If necessary, the granules may be further coated with inert coating materials such as neutralized polymers and copolymers, anti-dusting agents such as zeolites, magnesium oxide, magnesium carbonate and so on.

Although the invention is described with particular reference to DPDA, other aliphatic organic peroxyacids can also be used according to the present invention. Typical examples of such acids are diperoxyazelaic acid, diperoxysebacic acid, diperoxytetradecanedioic acid, peracetic acid, peroctanoic acid, peradamantoic acid, diperbrassylic acid and so on. In preparing the cogranulates of the present invention, one should preferably aim at getting cogranulates of a particle size, suitable for inclusion in a particulate detergent or cleaning composition, i.e. a particle size, about matching the particle size of the particulate detergent or cleaning composition, to avoid any undue segregation. In general, the particle size (average mean particle size) of the cogranulate should range from 100 to 2000 micrometers. The crystal particle sizes of the DPDA and of the hydratable salt can vary to some degree, but they should not be so different that the DPDA particles would dissolve before the water of hydration is taken up by the hydratable salt. Therefore, the particle size of the DPDA should be such that the rate of hydration of the hydratable salt is much faster than the rate of dissolution of the DPDA particle. The particle size of the DPDA can be as small as 0.009 micrometers, but is preferably larger; the particle size of the hydratable salt can range from 50 to 1000 micrometers.

If the granules are prepared by admixing an aqueous dispersion of the DPDA with the strongly alkaline hydratable salt, this is preferably done by spraying said aqueous dispersion of the DPDA onto a moving bed, or curtain of the hydratable salt in e.g. a rolling drum. The aqueous dispersion can be in the form of a wet filter cake of DPDA as obtained during the process of making DPDA, or it can be made from commercially available DPDA powder. It can also be used as such as it is received from the manufacturer, or it can be first extracted and filtrated to yield a more concentrated powder of DPDA with inert carrier salt, usually sodium sulphate, which is then reslurried with deionized water. Thus for example a slurry as obtained from the manufacturer is filtrated to give a powder with an increased level of DPDA, e.g. 50% or more, which powder is then reslurried with deionized water (2 parts powder per part of water). The hydratable salt is placed in a rolling drum, equipped with flights in the interior. As the drum rolls, the alkaline material tumbles and falls down the flights, forming thin curtains. Through a "syringe-like" opening, the DPDA slurry is pushed by air pressure to make a mist. This mist comes in contact with the moving curtain of the alkaline material and agglomerates with the particles to form granules of DPDA and alkaline agent as the water in the slurry hydrates the alkaline agent. The granules are then sieved to acceptable particle size and air dried. No other drying processes are done to the granules.

Another way of making cogranulates according to the present invention is to mix DPDA granules with particulate alkaline hydratable salts in a suitable mixer and spray the appropriate amount of water on the mixture. In this respect it has been found to be beneficial to use DPDA granules which also contain inorganic salts which have a pH of between about 6 and about 7, such as sodium sulphate or magnesium sulphate. Using such DPDA granules results in cogranulates with the alkaline salts with a reduced chemical decomposition, while still maintaining the benefit of a reduced tendency to detonate or explode.

The cogranulates of the invention can be used as ingredients in detergent cleaning and bleaching compositions for fabrics. Such cleaning and bleaching compositions incorporating the cogranulates in an amount of up to 50% usually contain one or more detergent-active materials, builders and other adjuvants commonly present in such compositions. Thus, they may contain from 1 to 40, usually from 2 to 35 and preferably from 5 to 30% by weight of an anionic, a nonionic, a cationic and/or a zwitterionic detergent-active material, all of which are well-known in the art. Suitable examples thereof are fully described in Schwartz, Perry and Berch, "Surface-Active Agents and Detergents", Vol. I (1949) and Vol. II (1958). The compositions may furthermore comprise up to 55% of one or more organic and/or inorganic builders, such as alkalimetal carbonates, alkalimetal citrates, alkalimetal nitrilotriacetates, zeolites, mixtures of alkalimetal carbonates with calcites and so on.

The compositions may furthermore comprise optional ingredients in amounts, commonly used in detergent compositions, such as lather boosters, foam depressors, anti-corrosion agents, soil-suspending agents, sequestering agents, anti-soil redeposition agents, perfumes, dyes, enzymes such as proteases, amylases, cellulases and lipases, bleach precursors, etc.

The compositions are preferably formulated in particulate forms, but other forms such as pastes, liquids, bars, cakes, etc. can also be used. The cogranulates of the invention are added to the particulate detergent composition by simple admixing them with the particulate composition.

The invention will be further illustrated by way of Example.

EXAMPLE 1

Commercially available DPDA-powder, containing 12% of DPDA and 88% sodium sulphate as inert carrier material was slurried with deionized water, extracted and filtrated to yield a concentrated powder containing 61.7% DPDA and 38.3% sodium sulphate.

24.6 g of this concentrated DPDA-powder was dispersed in 15 g of deionized water, and the resulting dispersion was sprayed as a mist onto 34.23 g of granular anhydrous sodium dibasic orthophosphate in a rolling drum. The resulting cogranulates were sieved and dried to the air.

60% of the resulting cogranulates had a particle size between +35 and −10 meshes. They had a DPDA-content of 11.2%. The cogranulates were subjected to the following autoignition test:

The apparatus used in measuring the Autoignition Temperature of peracid compositions consisted of a 1.25 O.D. inch by 7.0 inch capped steel pipe inserted into a heating mantle (Type 0-610, 325 watt) containing sand. The sample was placed into a 25×200 mm Pyrex glass tube and a thermocouple, shielded inside in a 0.25 O.D. inch glass tube, was inserted into the center of the sample. The glass tube containing the sample was then placed into the steel pipe. The heating mantle, controlled with a Powerstat (Type 3PN117C) to give a 2° C./min heating rate, was turned on. The temperature of the sample versus time was recorded. The autoignition temperature was taken as the point at which the sample ignited, as indicated by the sharp change in sample temperature. The cogranulates did not ignite up to a temperature of 200° C.

A similar experiment with sodium perborate monohydrate produced similar results.

EXAMPLE 2

In a similar manner as in Example 1, cogranulates were made from 24.64 g DPDA-powder (containing 62.99% DPDA and 37.01% sodium sulphate), dispersed in 11 g deionized water, sprayed onto 34.23 g granular anhydrous sodium dibasic orthophosphate. To the DPDA-dispersion was also added 0.06 g of ethanehydroxydiphosphonic acid.

After sieving and drying to the air, the following granules were obtained:

| | % DPDA normal titration | % DPDA titration on ice |
|---|---|---|
| (a) granules (−10, +35 mesh) | 30.60 | 28.93 |
| (b) granules on wall (−10, +35 mesh) | 34.62 | 33.97 |
| (c) clumps (+10 mesh) | 41.62 | — |
| (d) fines (−35 mesh) | 17.31 | — |

A combination of (a) and (b) cogranulates in the autoignition test showed a mild exotherm at 68° C., but it did not ignite.

EXAMPLE 3

Repeating the procedure of Example 1, using 30.2 g DPDA powder (57.78% activity, balance being sodium sulphate) in 9.8 g water, and using 41.95 g granular sodiumtetraboratepentahydrate yielded cogranulates with a level of 22.77% DPDA. These cogranulates did not show autoignition. In a similar experiment with 49.28 g DPDA powder (67.16% activity) in 23 g water, and using 64.46 g sodium carbonate (anhydrous), cogranulates with a DPDA-content of 20.88% were obtained. These cogranulates showed a mild exotherm, but no autoignition.

The foregoing description and Examples illustrate selected embodiments of the present invention. In the light thereof, various modifications will be suggested to one skilled in the art, all of which are within the spirit and purview of the invention.

EXAMPLE 4

4 parts of DPDA granules, comprising 20% DPDA and 80% sodium sulphate were mixed with 1 part of ground sodium tetraborate pentahydrate in a rolling drum. Water was then sprayed onto the mixture in the drum to form cogranulates.

The resulting cogranulates contained about 14% DPDA and did not show an exothermic reaction in the autoignition test. Granules containing 12% DPDA and 88% sodium sulphate and no alkaline salt ignited at 126° C.

What is claimed is:

1. A cogranulate comprising 1–45% by weight of an aliphatic organic peroxyacid and 99–35% by weight of an alkaline, hydratable alkalimetal inorganic or organic salt, said salt having a pH of at least 8.5 at a concentration of 1% in distilled water at 25° C., and said cogranulate being formed in a process wherein all water employed therein is taken up by said hydratable salt as water of hydration.

2. A cogranulate according to claim 1, wherein the aliphatic organic peroxyacid is diperoxydodecanedioic acid.

3. A cogranulate according to claim 1, wherein the alkaline, hydratable alkalimetal inorganic or organic salt has a pH of at least 9.0 at a concentration of 1% in distilled water at 25° C.

4. A cogranulate according to claim 1 wherein the alkaline hydratable alkalimetal inorganic salt is selected from the group consisting of sodium dibasic orthophosphate, sodium carbonate, sodium tetraborate, and sodium perborate.

5. A cogranulate according to claim 1, prepared from an aliphatic organic peroxyacid with a particle size greater than 0.009 micrometers and a granular, alkaline hydratable salt having a crystal particle size of 50 to 1000 micrometers.

6. A particulate detergent and bleaching composition comprising from 1 to 40% of at least one detergent-active compound, up to 50% by weight of at least one builder and a bleaching agent, wherein the bleaching agent is a cogranulate of 1–45% by weight of an aliphatic organic peroxyacid and 99–35% by weight of an alkaline, hydratable alkalimetal inorganic or organic salt, said salt having a pH of at least 8.5 at a concentration of 1% in distilled water at 25° C. and said cogranulate being formed in a process wherein all water employed therein is taken up by said hydratable salt as water of hydration.

* * * * *